US007681288B1

(12) United States Patent
Giampavolo

(10) Patent No.: US 7,681,288 B1
(45) Date of Patent: Mar. 23, 2010

(54) STRUCTURE AND MATERIAL FOR A CHILD RESISTANT BUCKLE

(76) Inventor: Paul Giampavolo, 10 Kingsbridge Rd., Fairfield, NJ (US) 07004

( * ) Notice: Subject to any disclaimer, the term of this patent is extended or adjusted under 35 U.S.C. 154(b) by 0 days.

(21) Appl. No.: 11/220,038

(22) Filed: Aug. 31, 2005

Related U.S. Application Data

(63) Continuation-in-part of application No. 11/205,295, filed on Aug. 15, 2005, which is a continuation-in-part of application No. 11/090,696, filed on Mar. 25, 2005, now Pat. No. 7,513,020, which is a continuation-in-part of application No. 10/811,168, filed on Mar. 26, 2004, now Pat. No. 7,559,126, application No. 11/220,038, which is a continuation-in-part of application No. 10/639,964, filed on Aug. 11, 2003, which is a continuation-in-part of application No. 09/952,070, filed on Sep. 13, 2001, now Pat. No. 6,604,265.

(60) Provisional application No. 60/232,546, filed on Sep. 14, 2000, provisional application No. 60/605,855, filed on Aug. 31, 2004.

(51) Int. Cl.
*A44B 11/25* (2006.01)
*A44B 11/26* (2006.01)

(52) U.S. Cl. ..... 24/615; 24/614; 24/625; 24/629; 24/662

(58) Field of Classification Search ..... 24/614, 24/615
See application file for complete search history.

(56) References Cited

U.S. PATENT DOCUMENTS 4,150,464 A * 4/1979 Tracy ..... 24/313
4,458,392 A 7/1984 Pogharian et al. ..... 24/664
4,501,027 A * 2/1985 Olsson ..... 2/321
4,712,280 A 12/1987 Fildan ..... 24/625
4,825,515 A * 5/1989 Wolterstorff, Jr. ..... 24/625
4,991,272 A 2/1991 Bianchi
5,263,726 A 11/1993 Wood (Continued)

FOREIGN PATENT DOCUMENTS

EP 0 348 075 A1 12/1989

(Continued)

OTHER PUBLICATIONS

United Kingdom Department of Trade and Industry publication titled "Assessment of broad age-related issues for package opening", "Appendix 1: A case study—child resistant closure" prepared by Dr. Laxman Nayak, Mar. 1999 (This document can also be view at http://www.broadband.gov.uk/homesafetynetwork/pdf/packopen.pdf).*

*Primary Examiner*—Robert J Sandy
(74) *Attorney, Agent, or Firm*—Weingarten, Schurgin, Gagnebin & Lebovici LLP

(57) ABSTRACT

A child safety buckle used in a child restraint includes structural support and selected materials to resist deformation or failure when subjected to impact or compressive forces. The buckle may have a child resistant feature that is more tolerant to impact or compressive forces due to the structural support and material selection. The structure may include thickened walls or added arcuate portions or ribs. The material can be impact modified nylon to improve durability while resisting deformation and cracking. The resulting buckle design is more robust in harsh environments, while providing consistent operation for restraining a child.

19 Claims, 10 Drawing Sheets

U.S. PATENT DOCUMENTS

| | | | | | |
|---|---|---|---|---|---|
| 5,307,544 | A | * | 5/1994 | Quarberg et al. | 24/633 |
| 5,398,383 | A | * | 3/1995 | Bingold | 24/16 PB |
| D359,464 | S | | 6/1995 | Grasso et al. | |
| 5,465,472 | A | | 11/1995 | Matoba | |
| 5,546,642 | A | | 8/1996 | Anscher | |
| 5,659,931 | A | | 8/1997 | Anscher | |
| 5,774,956 | A | | 7/1998 | French et al. | 24/625 |
| 5,791,026 | A | | 8/1998 | Ancher | |
| 5,794,316 | A | | 8/1998 | Ancher | |
| 5,855,057 | A | | 1/1999 | Anscher | 24/614 |
| D405,723 | S | | 2/1999 | Ancher | |
| 5,991,985 | A | | 11/1999 | Galbreath | 24/625 |
| 6,000,109 | A | | 12/1999 | Anscher | 24/614 |
| 6,052,875 | A | | 4/2000 | Fudaki | |
| 6,138,330 | A | | 10/2000 | Galbreath | 24/625 |
| 6,145,172 | A | | 11/2000 | Bourdon | 24/625 |
| 6,148,486 | A | | 11/2000 | Uchara et al. | |
| 6,163,942 | A | | 12/2000 | Liao | 24/625 |
| 6,263,549 | B1 | | 7/2001 | Uchara | |
| 6,311,374 | B1 | | 11/2001 | Anscher | 24/625 |
| 6,363,590 | B1 | | 4/2002 | Lan | 24/614 |
| 6,446,314 | B1 | | 9/2002 | Anscher | 24/614 |
| 6,662,414 | B1 | | 12/2003 | Niewiadomski | 264/625 |
| 6,684,466 | B2 | | 2/2004 | Nishida et al. | 24/615 |
| 6,728,999 | B2 | | 5/2004 | Murai et al. | 24/615 |
| 2004/0226150 | A1 | | 11/2004 | Beletsky | 24/625 |
| 2005/0076483 | A1 | | 4/2005 | Chen | 24/615 |

FOREIGN PATENT DOCUMENTS

| | | | | |
|---|---|---|---|---|
| GB | 2 150 632 | A | | 7/1985 |
| JP | 07051106 | A | | 2/1995 |
| JP | 408-84610 | A | | 4/1996 |
| JP | 2001-61514 | A | | 3/2001 |
| WO | WO 84/01275 | | * | 4/1984 |

* cited by examiner

STRUCTURE AND MATERIAL FOR A CHILD RESISTANT BUCKLE

RELATED APPLICATIONS

This application is a continuation-in-part of U.S. patent application Ser. No. 10/639,964, filed Aug. 11, 2003, entitled Seat Belt with Child Resistant Buckle, which is a continuation-in-part of U.S. patent application Ser. No. 09/952,070, filed Sep. 13, 2001 now U.S. Pat. No. 6,604,265, entitled Child Resistant Buckle, which claims the benefit of U.S. Provisional Patent Application Ser. No. 60/232,546 filed on Sep. 14, 2000, and this application is also a continuation-in-part of U.S. patent application Ser. No. 11/205,295 filed on Aug. 15, 2005, entitled Safety Buckle with Passive Catch, which is a continuation-in-part of U.S. patent application Ser. No. 11/090,696 filed on Mar. 25, 2005 now U.S. Pat. No. 7,513,020, entitled Safety Buckle with Multiple Orientation Clasp, which is a continuation-in-part of U.S. patent application Ser. No. 10/811,168, filed on Mar. 26, 2004 now U.S. Pat. No. 7,559,126, and this application also claims benefit of U.S. Provisional Patent Application Ser. No. 60/605,855, filed on Aug. 31, 2004 entitled Seatbelt with Child Resistant Buckle.

STATEMENT REGARDING FEDERALLY SPONSORED RESEARCH OR DEVELOPMENT

N/A

BACKGROUND OF THE INVENTION

1. Field of the Invention

The present invention relates generally to child resistant safety buckles used with a strap, and relates more particularly to the structure and materials used to form child resistant safety buckles for securing a child in a seat.

2. Description of the Related Art

Child safety buckles are used in a number of child restraint applications including securing children in strollers, high chairs and shopping carts. Child restraints contribute to securing a child in a seat to prevent the child from being free and thus avoid situations in which the child might be in danger or injured. A prior art buckle 25 with a male part 20 and a female part 30 for use in a seatbelt assembly is illustrated in FIGS. 1*a* and 1*b*. Buckle 25 has two arms 10 on male part 20 that slide into a slot 12 of a female part 30. Barbed ends 14 of arms 10 engage shoulders 15 in female part 30 when buckle 25 is clasped. Buckle 25 can be manipulated by some young children to unclasp the buckle. As is well known, buckle 25 is unclasped by pressing together or pinching barbed ends 14 toward each other until free of shoulders 15. Once ends 14 are free, male part 20' can be removed from female part 30.

A particular type of safety buckle is child resistant, to prevent children under a given age from releasing the buckle and freeing themselves. Although children under a certain age are prevented from unclasping the buckle, adults typically have no difficulty in disengaging the buckle to free the child. One type of buckle that is child resistant but can be opened by an adult has a double action feature to permit the buckle to be opened. That is, the buckle is opened by operating several disengaging elements to unlatch the buckle and disengage the buckle portions. By providing two actions to allow the buckle to be opened, the buckle is made child resistant, because a typical child under a certain age is unable to properly operate the two features, either sequentially or at the same time, for example, to unlatch and open the buckle. At the same time, an adult can easily and intuitively disengage the buckle by operating the two features as required.

A number of buckles are available that, while not designed to be child resistant, do have security features, so that the buckles will not disengage unexpectedly. These types of buckles also have a multi-open feature, in that a number of operations are conducted on the buckle to permit the buckle to be unlatched and opened. Typical applications for these types of buckles involve heavy duty or industrial uses, such as clasps for utility belts, sportswear or other applications where the buckle is subjected to high loading or must be well secured.

One such high security buckle is shown in U.S. Pat. No. 5,774,956 to French et al., which discloses a buckle with flexible side release latches and a third latch accessible on the front of the buckle. The male portion of the buckle includes a central latch arm that engages the female portion of the buckle in a central portion, and is released by pressing on a central button on one side of the female buckle portion. The buckle unlatches when both side latch arms are moved inwardly, and the central arm is moved away from the catch on the female portion. The buckle unlatches when all three arms are moved to unlatched positions simultaneously. Changing the orientation of the male portion when inserted into the female portion results in the central arm catch being defeated, because there is no corresponding catch cooperation on the back side of the female.

U.S. Pat. No. 5,991,985 to Galbreath discloses a safety buckle (the '985 buckle) with side catch arms and a central catch that engages with a depressible button catch on the female portion of the buckle. To disengage the buckle, the central button on the female portion of the buckle is depressed to either disengage from the central arm or displace the central arm to disengage from a catch. If the male portion of the buckle is inserted into the female portion of the buckle in an opposite orientation so that the central arm does not engage the depressible button catch, the buckle either does not clasp or the central arm does not latch.

U.S. Pat. No. 6,311,374 to Anscher shows a two-operation buckle (the '374 buckle) with a center arm that includes a push button near the base of the male member with a catch near the push button to engage an opening catch in the female member when the buckle portions are engaged. In addition, the buckle is non-reversible, i.e., if the male member is inserted in an opposite orientation, so that the push button faces the back of the buckle assembly, the male and female members do not engage with each other.

U.S. Pat. No. 6,684,466 to Nishida et al. shows a two-operation safety buckle in which the male member has a center arm with a catch recess that engages a catch on the female member. The center arm of the male member is displaced downwardly during insertion to permit the latch member to protrude into the latch recess when the male member is fully inserted and the center arm returns to its undisplaced position. The center arm is disengaged from the catch with a button on the female member that is pressed to displaced the center arm away from the catch of the female member, so that the male member can be withdrawn from the female member, with the sidearms being depressed together. This buckle configuration is not reversible, in that if the male is inserted in an opposite orientation, the center arm does not latch with the female latch member. Due to the shape of the buckle components, high stress environments may have a further adverse impact on the buckle. For example, if the buckle deforms, a situation where the buckle can be clasped but not unclasped may occur.

U.S. Pat. No. 6,138,330 (the '330 patent) to Galbreath discloses a two-operation safety buckle in which the sidearms of the male member are prevented from being squeezed together to unlatch the buckle, when the male and female members are engaged together. A blocking device in the female member engages with the latching arms of the male member to prevent their displacement and thus prevent them from being unlatched until the blocking device is displaced away from the latching arms to permit their relative movement. Accordingly, the blocking device is first displaced, and then the arm latches are displaced towards each other until they are free of their respective latches in the female member, at which point the male member can be withdrawn from the female member. The configuration of this buckle permits the male member to be inserted in the female member in an opposite orientation. The blocking device and arm latching functions of this buckle are not independent of each other when the buckle is in a clasped condition. The arms are prevented from being operated due to the blocking device, which is first displaced away from the arms before they may be operated. The sequential operation to unblock the arms represents a major departure from other conventional buckles where the latching mechanisms are independent in the clasped condition. This difference is significant to operation in a commercial environment where buckles are subject to forces that routinely alter their shape. Even slight forces may deform a given buckle, resulting in the buckle being prone to jamming.

Moreover, the buckle of the '330 patent is difficult to manufacture due to practical tolerance limitations in the materials and the amount of area within the confines of the buckle interior. In addition, the buckle configuration is not designed to withstand high impact or compressive forces that are typically encountered in safety buckle applications. The combination of small manufacturing tolerances and lack of resilience to environmental factors contribute to operational problems. For example, small changes in tolerances due to impact or compressive forces, or through extreme temperature ranges, may influence operation of the blocking device leading to buckle failure. The buckle material can exacerbate the above challenges when an inexpensive or typically brittle material such as acetal or nylon is used.

A particular failure mode that is highly undesirable occurs when the deformed buckle can be easily clasped, but becomes extremely difficult to unclasp. Often, such failed buckles may respond to the application of brute force to be opened, such as the application of a high tensile force or prying force. However, a buckle with a blocking action typically does not respond to brute force methods to open the buckle due to the particular nature of the blocking mechanism design. In such a situation, the belt attached by the buckle is cut away to free the occupant, destroying the usefulness of the belt and buckle.

In each of the above two-operation safety buckles, a change in the shape of the male or female member may cause the buckle either not to clasp, or to clasp with great difficulty or produce the problematic possibility that the easily clasped buckle may not easily unclasp. In a case of the '330 patent to Galbreath, there are challenges to making the buckle impact resistant or durable in stressful environments to avoid changes in shape. For example, if the buckle becomes deformed due to impact or compression, it is extremely difficult to unlatch the buckle.

Indeed, conventional buckles are often made with materials that are inexpensive to avoid increased costs for the buckle components and seatbelts overall, for example. Low cost materials, such as acetal, tend to be brittle and somewhat inflexible, and the structural elements tend to be more difficult to operate. Accordingly, the structural elements that are manipulated to operate the buckle are minimized to maintain the operational characteristics of the buckle and permit the structural elements to be more easily operated. However, this minimization tends to limit the operational robustness of the manipulated structural elements. Accordingly, buckle types like that illustrated in FIGS. 1*a* and 1*b* have diminished usefulness in child restraint applications due to rapid failure in practical applications when composed of less robust materials.

The challenges noted above become particularly difficult in applications involving child resistant safety buckles in seatbelts for children. Specifically, shopping cart seat belts for children are subjected to extreme environmental conditions including wide variations in temperature and humidity, direct sun, snow, ice, high impact and compressive forces, and so on. The importance of providing a child resistant buckle, however, prompts the desire to overcome these challenges, and provide a buckle that is not easily opened by children under a certain age. For example, the child restraint should not be defeated by a child 4 years or 48 months old, and should be capable of being readily opened by adults or older minors, for example, of 16 years of age or older. Indeed, a standard for child resistant child restraints is available to help manufacturers and suppliers reach this goal. However, the challenges of maintaining child resistant features in extreme application environments remain.

When the types of buckles and straps described above are used in an environment where the buckles are typically subjected to high impact and compression forces, the buckle can be damaged. When child resistant buckles and straps are used as child safety restraints on grocery shopping carts, for example, the design and functionality of the buckles is severely tested. When carts are nested together with one another for storing large numbers of carts easily, for example, the buckles can be caught between the carts and can be subjected to high impact and compressive forces. Impact forces like these tend to cause the buckles to crack or even shatter. Compressive forces can deform the buckle beyond a point of elastic resilience, resulting in an unworkable buckle.

In addition, the seatbelt assembly is sometimes misused in connecting grocery carts together, for example, to tow a number of carts all at once. These occasions of misuse can produce high tensile strain on the buckle, causing the buckle to fail and resulting in damage to buckle components.

It would be desirable to obtain a child resistant buckle, that has a design or structure that can take advantage of selective materials to be robust under extreme conditions. functions.

BRIEF SUMMARY OF THE INVENTION

It is an object of the present invention to overcome the drawbacks associated with the prior art.

It is a further object of the present invention to provide a seatbelt assembly with a child resistant buckle while maintaining design and operating features similar to those provided in the prior art and simplicity of operation.

It is a further object of the present invention to provide a seatbelt assembly that is resistant to high tensile, impact and compressive forces.

Briefly stated, according to the present invention there is provided a seatbelt assembly with a buckle with male and female mating parts, in which the male and female parts include features to prevent disengagement operation by a child. The child resistant features include added ribs, webbing in the form of flanges or struts, or barbs or prongs that increase the difficulty for disengaging the buckle. The force to disengage the buckle is set at a threshold level that is above a force level that a child can exert on the buckle. The buckle can be operated easily by an adult, while remaining secure from disengagement by a typical child. The female part has an arcuate outer profile to improve the structural integrity of the overall buckle. Both the male and female parts can have thickened portions to permit the seatbelt assembly to be child resistant, while improving resistance to tensile, impact and compressive forces and protecting child resistant features. A gap between the male and female buckle parts, and/or a non-functional area, serves to enhance the child resistant characteristics of the buckle.

According to an aspect of the present invention, child resistant features and ergonomic features are enhanced with structural improvements in combination with selection of specified material. Child resistant features may include increased difficulty for disengagement of clasp elements, passive latch elements that may increase the difficulty of separating buckle parts, non-operative ranges for actuation mechanisms, dual action unclasping mechanisms, and other mechanisms that may depend on the lesser strength and size of children. Ergonomic features may include relative buckle orientation and arrangement of male and female components on particular sides of a seat.

According to a feature of the present invention, a female member of a buckle is provided with a slot that cooperates with a center arm of a male member to provide enough clearance for the center arm of the male member to be displaced a distance sufficient to engage/disengage the center arm from a catch projection on the female. The slot, or trench, permits the center arm to be displaced a greater distance to provide a range of adjustment or tolerance for the passive catch or resistance provided by the cooperation of the center arm and the catch projection. The greater displacement capability of the center arm permits the catch projection on the female member to be extended, so that a more secure child resistant feature can be provided.

In accordance with another feature of the present invention, a center arm of a male buckle member includes a recess, which in an exemplary embodiment is a through opening, to cooperate with a catch protrusion in the female buckle member. By providing the recess or through opening, a longer catch protrusion may be used on the female buckle member to interact with the center arm to secure the buckle as with a passive catch. The use of the longer catch protrusion on the female permits the catch to exhibit greater resistance to separation of the buckle parts and improves the child resistant aspect of the buckle.

In accordance with another feature of the present invention, a center post of a male buckle member is tapered to improve a release action from a catch in the female buckle member. The center post may be tapered near an end of the center post, so that the center post need not be displaced as great a distance to enable the passive catch feature to be more easily engaged/disengaged when the center post is displaced in cooperation with the female buckle member catch protrusion. The tapered center member may be provided in combination with the recess or through opening in the center member to provide additional security for the catch, while permitting the catch to perform more consistently, for example. The slot or trench feature provided in the female buckle member may also be used with the taper and recess feature to permit the center member to be displaced a greater distance to improve latch reliability while obtaining a smooth and easy release. These features also contribute, individually or in combination, to increasing operating consistency when the buckle is clasped in multi-orientations.

In accordance with another feature of the present invention, the child resistance of a buckle may be improved by providing a false actuator. Such a false actuator can have a non-functioning range of operation, so that it appears to actuate a disengagement mechanism to a child, but has no impact on buckle function. Accordingly, children attempting to actuate the latch in an unlatching operation by operating the false actuator observe no results so that the child is deterred from unlatching the latch.

The buckle of the present invention is composed of a flexible and durable material designed to withstand impact or compressive forces to avoid, for example, permanent deformation of the buckle and create a more robust structure. The buckle may be molded from a variety of materials. These materials may include LDPE, HDPE, ABS, polystyrene, polypropylene sulfides, acetals, polycarbonates, thermoplastic rubbers, and polyesters, among others. According to a feature of the present invention the buckle is composed of a material that is both durable and flexible, such as, for example, impact modified nylon. The use of such a material permits the buckle to have operative structural elements that have greater structural integrity, such as by increasing a dimension of the structural element or elements, without significantly increasing operational difficulty. The selection of such a material contributes to the overall integrity of buckle operation, because it is durable enough to withstand high impact or compressive forces, while permitting the operative structural elements to be relatively easy to operate, even if increased in dimension.

According to another feature of the present invention, the buckle is formed to have latching arms in the male portion that exhibit a particular force resistance to being compressed together. According to this feature, a child is typically unable to compress the latching arms of the male member sufficiently to disengage the buckle, even if a second latching mechanism is unlatched. The force used to operate the buckle is sufficiently low to permit an adult to easily operate the buckle. In an exemplary embodiment, a minimum force to actuate the latching arms is 5 lbs or greater to prevent operation by a child under a certain age. The actuating force can also be less than a maximum force of 16 lbs. to permit easy operation by an adult.

According to an advantage of the present invention, structures are provided on the latching arms to increase their resistance to displacement. These structures can be in the form of ribs, struts or flanges, for example.

The selection of materials for the present invention also contributes to maintaining the child resistant features in harsh environments. For example, the selection of high impact nylon, provided by Dupont as material ST801, permits the child resistant buckle to absorb impact and compressive loading forces without permanently deforming to avoid the loss of child resistant features. The selection of the impact modified nylon also permits tolerances in the manufacture of the buckle to be maintained, even in harsh environments where the buckle is subjected to high impact or compressive forces, or wide variations in temperature. Accordingly, the selection of the material further improves the child resistant features of the buckle by maintaining those features even in outdoor environments or harsh environments, such as when the buckle is used in a shopping cart seatbelt.

According to another feature of the present invention, the buckle is designed to have walls with a shape and/or thickness to maintain a certain level of robustness in maintaining a preferred configuration of the buckle. For example, providing structures that improve the resistance of the buckle to compressive or impact forces, or thickening support structures for the buckle, improves the child resistant nature of the buckle by maintaining child resistant features or tolerances in the face of high external forces applied to the buckle.

Other features and advantages of the present invention will be apparent from the following detailed description to be read with the accompanying drawings as described below.

DETAILED DESCRIPTION OF THE PREFERRED EMBODIMENT

Figure 1A:
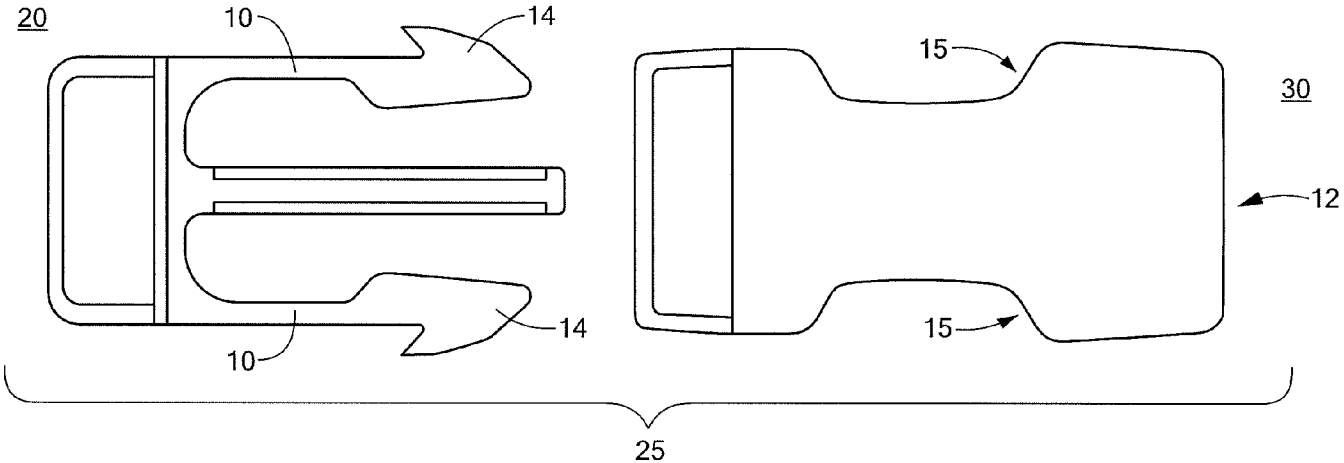
FIG. 1a PRIOR ART
FIG. 1*a* is a plan view of a male and female connector for a conventional buckle for a child restraint.
Figure 1B:
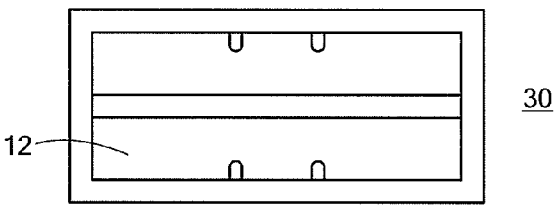
FIG. 1b PRIOR ART
FIG. 1*b* is a side view of a female connector for a conventional buckle for a child restraint.
Figure 2:
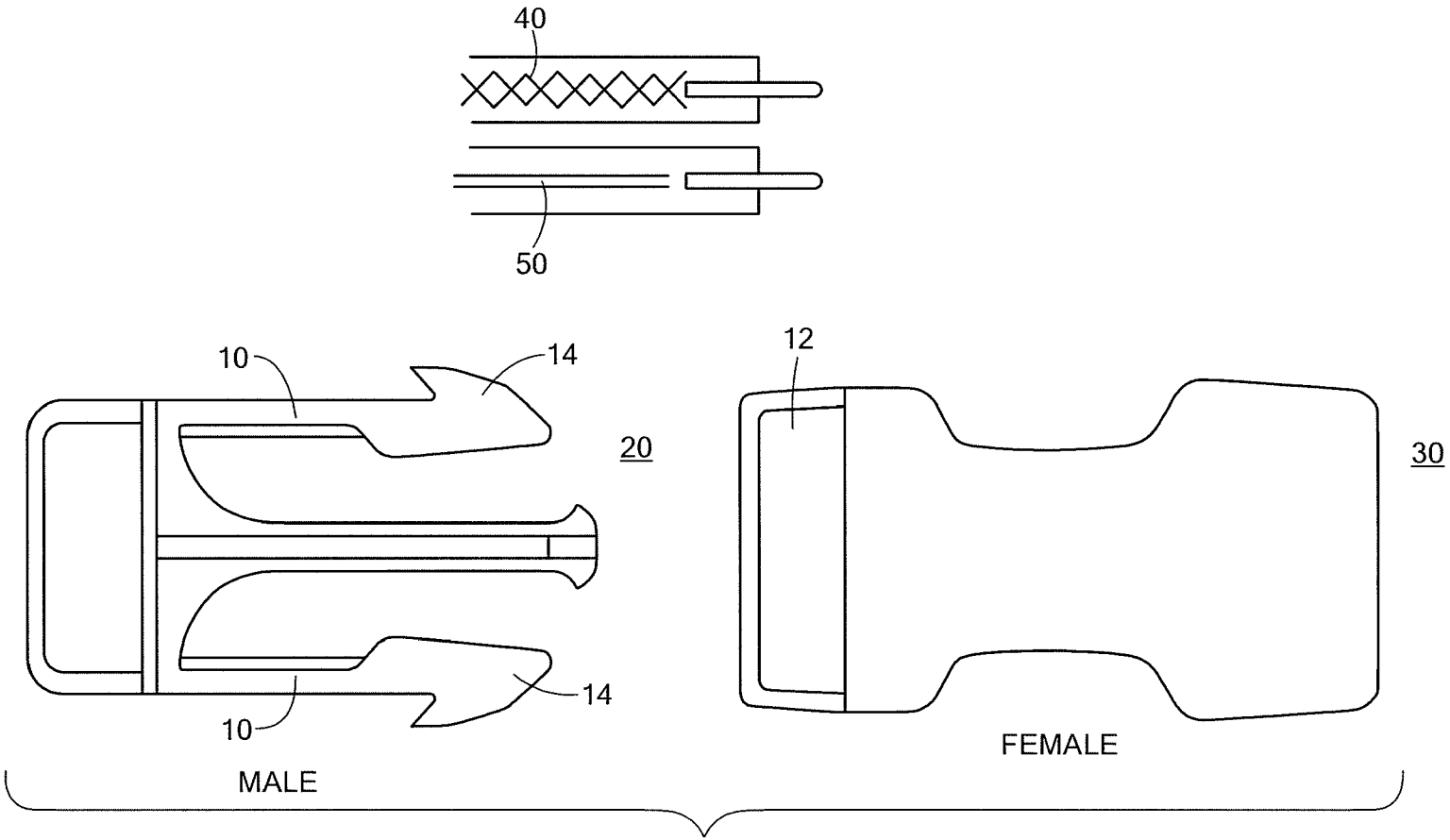
FIG. 2 is a plan view of an embodiment of a male and female portion of a safety buckle according to the present invention.
Figure 3:
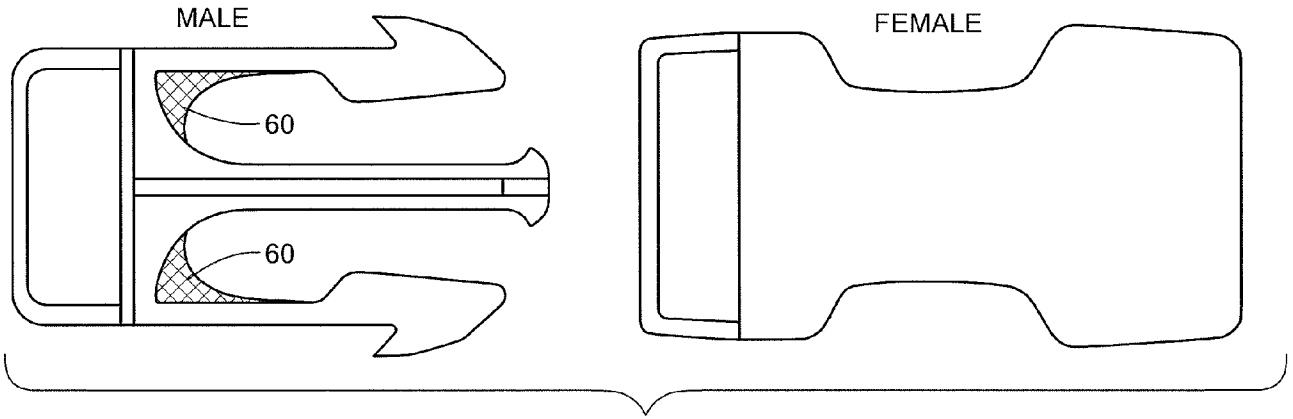
FIG. 3 is a plan view of another embodiment of a male and female portion of a safety buckle according to the present invention.
Figure 4:
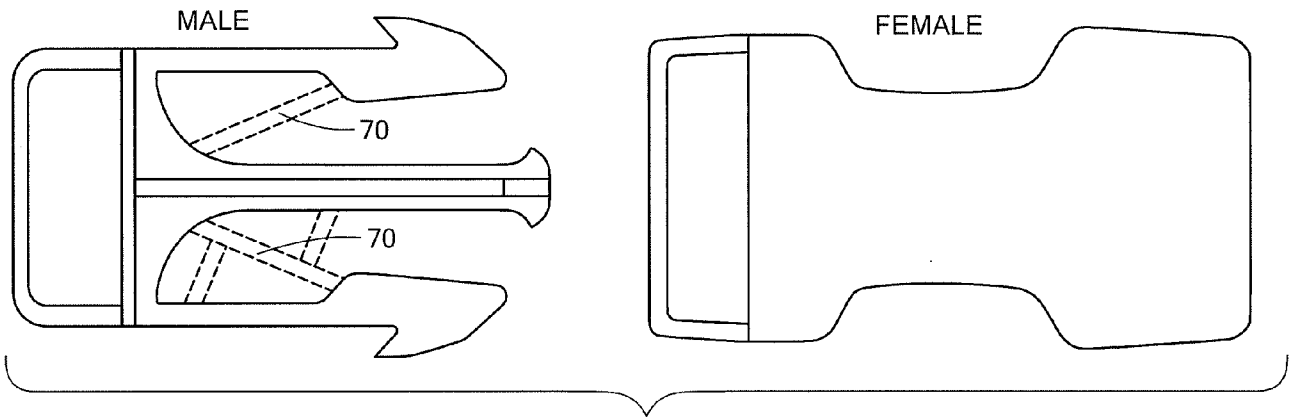
FIG. 4 is a plan view of another embodiment of a male and female portion of a safety buckle according to the present invention.

The entire contents of U.S. Pat. Nos. 6,604,265 and 6,618,915 and U.S. application Ser. Nos. 60/232,546, 60/270,996, 60/421,932, 60/605,855, 60/641,346, 10/693,964, 10/811,168, 11/090,696 and 11/205,295 are hereby incorporated herein by reference.

The present invention provides a simple child safety buckle with design, structure and material selection features that represent a substantial improvement over the prior art. The buckle is resistant to tensile, impact and compressive forces, and is operated conventionally to unclasp the buckle. The buckle may realize one or more child resistant features, including increased force or displacement applied to unclasp the buckle, non-operative ranges of actuation, multiple latch mechanisms, and so forth.

Referring to FIGS. 2-6, in which like elements are designated with like reference designations, child resistant features for seat belt buckles are illustrated. According to one embodiment, side arms 10 are reinforced with a strengthening structure to increase the force applied to unclasp the buckle. For example, as shown in the drawings, a patterned rib 40 or straight rib 50 may be added, webbing 60 can be added in the form of a flange and struts 70, either single or multiple struts, which are collapsible upon the application of a threshold force, can be provided.

Figure 5:
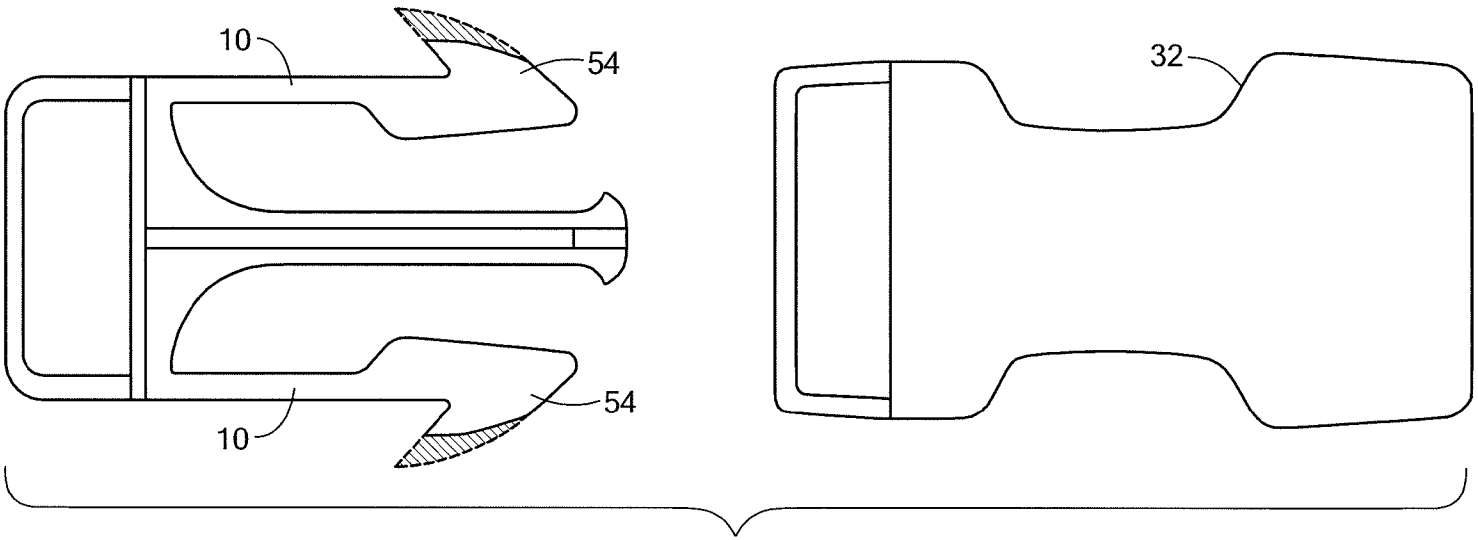
FIG. 5 is a plan view of another embodiment of a male and female portion of a safety buckle according to the present invention.

According to another embodiment, as shown in FIG. 5, barbs or prongs 54 are enlarged so that side arms 10 are displaced a greater distance from the female shoulders 32 be disengaged, thereby increasing the displacement and/or force for disengagement.

Figure 6:
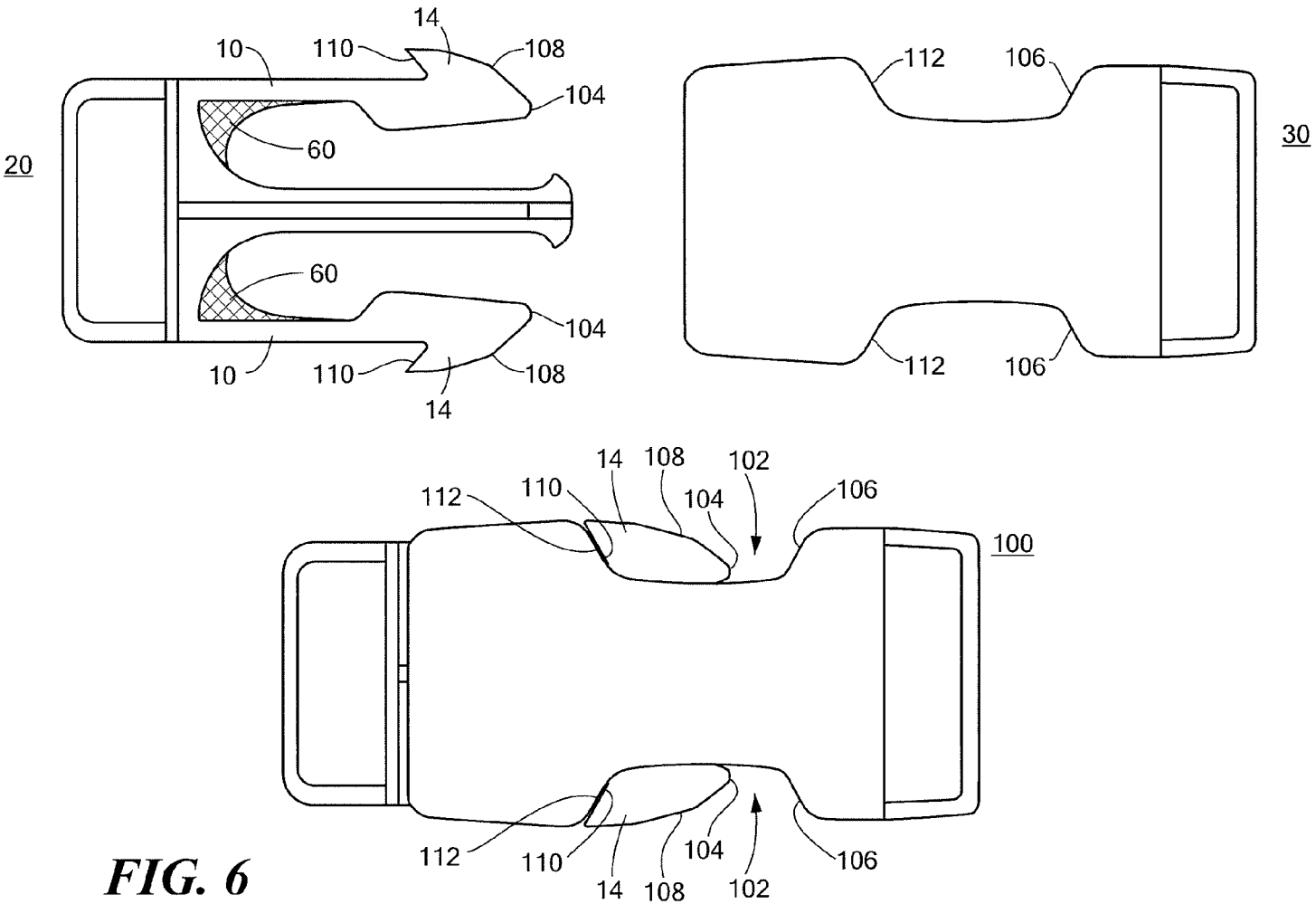
FIG. 6 is a plan view of another embodiment of a male and female portion illustrating a feature of a safety buckle according to the present invention.

Referring now to FIG. 6, another child resistant feature according to the present invention is illustrated in a clasped buckle 100. Clasped buckle 100 is, for example, the union of male connector 20 and female connector 30 in an engaged arrangement. With male connector 20 and female connector 30 engaged as shown to obtain clasped buckle 100, a gap 102 is provided on either side of female connector 30, in between a pointed end portion 104 of barbs 14, and a slot wall 106 on female connector 30. By providing gaps 102 between pointed portion 104 and walls 106, a child attempting to release the buckle has their fingers urged into gaps 102, preventing the child from opening the buckle. Barbs 14 have a sloped surface 108 that assists in the child resistant feature. A child seeking to unclasp the buckle may attempt to pinch barbs 14 together to release male connector 20 from female connector 30. In doing so, the child's fingers ride along slopes 108 and are urged by the slopes into gaps 102, effectively preventing the child from exerting a force on barbs 14 that would be sufficient to open the buckle.

In conventional buckles, gaps 102 do not exist, or are insufficiently large enough to accommodate a child's finger. Accordingly, a child pinching a set of conventional barbs is able to exert greater pressure on the barbs, even if the child's fingers slide towards ends of the barbs, because the child's fingers do not come to rest at a disabling portion of the clasped buckle. Rather, in the conventional buckle, the child will find support for their fingers in the sloped side wall of the female member that is close enough to the barbs to permit the child to exert leverage on both the sloped side wall and the prongs to achieve an opening force sufficient to unclasp the buckle.

The embodiment shown in FIG. 6 is additionally advantageous when webbing 60 is provided on male connector 20, for example. Webbing 60 tends to increase the stiffness of side latches 10, so that barbs 14 move in an arcuate path when pinching pressure is applied. That is, side latches 10 tend to flex near a base of barb 14, rather than near a base of side latch 10. Accordingly, barb 14 moves in an arcuate path that further promotes child resistance in the clasped buckle illustrated in FIG. 6.

When a child attempts to pinch barbs 14 together to unclasp the buckle, and the child's fingers slide into gaps 102, the child still may be able to exert a force near pointed portions 104 in an attempt to displace barbs 14 to unclasp the buckle. However, because barbs 14 move in an arcuate path, even if the child is successful in displacing barbs 14 towards each other with a pinching force, because the force is applied in proximity to gaps 102, the arcuate path of barbs 14 causes pointed portions 104 to move closer to each other at a greater displacement than catches 110 on barbs 14. Accordingly, even thought the child can compress pointed portions 104 together, catches 110 remain securely positioned on shoulders 112 of female connector 30. In contrast, an adult is easily able to compress barbs 14 together by applying pressure at a location away from pointed portions 104 to sufficiently displace barbs 14 so that catches 110 are disengaged from shoulders 112, and the buckle is released. Even if an adult's fingers slides down slopes 108, and into gap 102, the pressing force exerted by the adult is capable of displacing barbs 14 sufficiently to open the buckle. In addition, an adult's fingers are typically larger in diameter than a child's fingers, permitting the adult to provide a greater displacement on barbs 14, even when the adult's fingers are in gaps 102.

Figure 7:
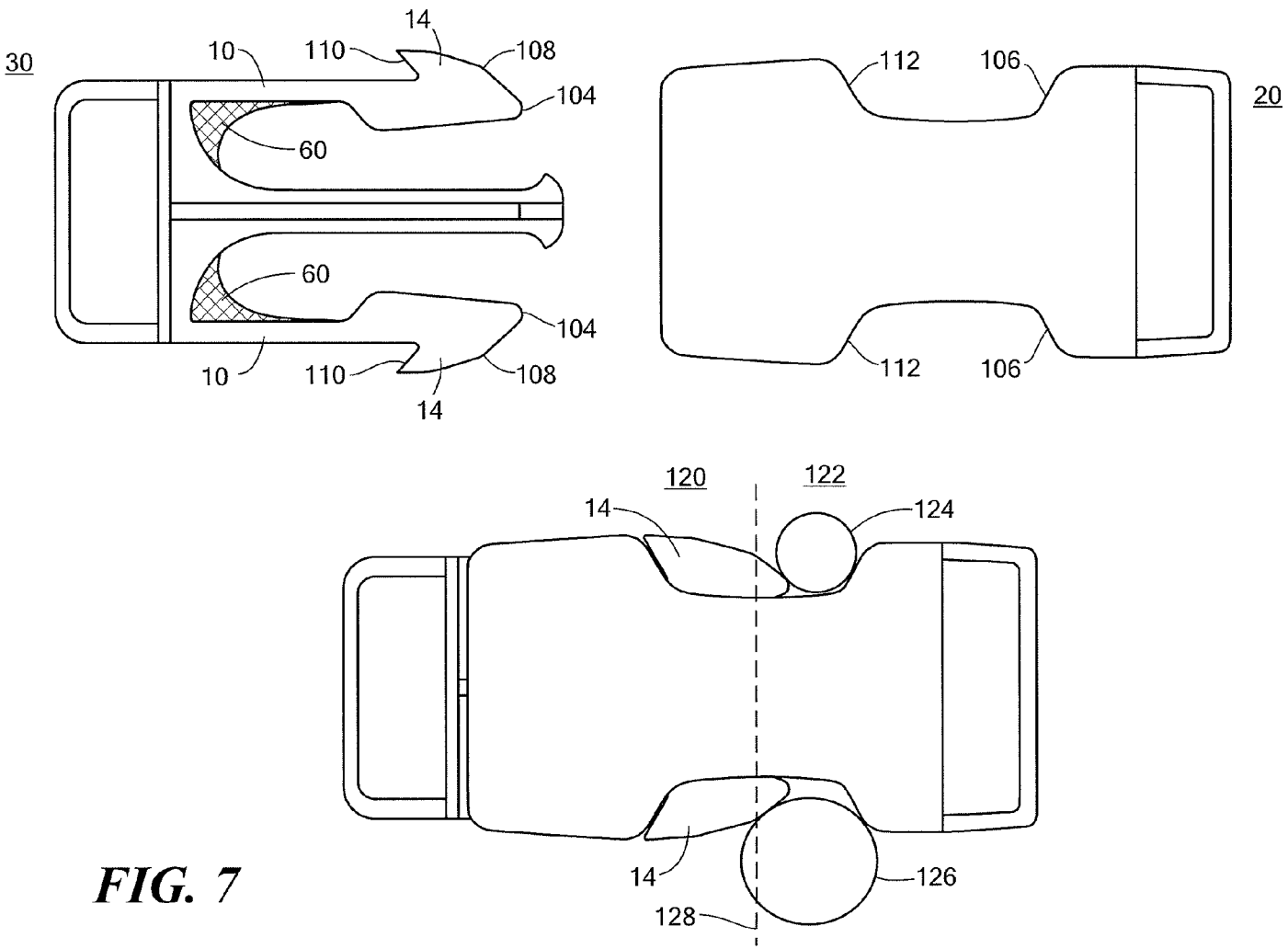
FIG. 7 is a plan view of another embodiment of a male and female portion illustrating a feature of a safety buckle according to the present invention.

Referring now to FIG. 7, a child's finger 124 and an adult's finger 126 is illustrated positioned in gaps 102. As can be seen from the drawing, child finger 124 is easily accommodated in gap 102, while adult finger 126 is too large to completely fit in gap 102. Accordingly, even if child finger 124 can exert a large force, the buckle will not unlatch due to the position of finger 124. Adult finger 126, on the other hand, is able to deflect barbs 14 to open the buckle.

With respect to finger size, even though both child and adult fingers 124, 126 substantially slide into gaps 102, child finger 124 is totally within a non-functional zone 122, as indicated with dashed divider line 128. Adult finger 126, however, overlaps barb 14 to lie within a functional zone 120. Because adult finger 126 is able to move barb 14 in functional zone 120 because of an appropriate sizing, an adult can open the buckle, where a child cannot. In addition, child finger 124 is prone to landing in gap 102, which is completely in non-functional zone 122, through the action of slopes 108. A child is thus unable to get a good grip on barb 14 due to lack of a stable landing or footing for child finger 124 on barb 14. Furthermore, slot walls 106 tend to help an adult secure a footing in pressing barbs 14, since adult finger 126 is large enough to abut slot wall 106 while remaining at least partially in functional zone 120.

It should be apparent that non-functional zone 122 can be tailored to a given application. For example, gaps 102 can be eliminated but non-functional zone 122 can remain the same. That is, a child may depress barb 14 in non-functional zone 122 when there is no gap 102 provided, however, that barb 14 will not displace sufficiently for the buckle to open.

Gap 102 can be created a number of ways, for example by extending female connector 30, or shortening male connector 20. The slot openings on either side of female connector 30 can be made deeper or shallower, or have a contour to assist in disabling the buckle for child fingers. For example, the slot openings can be shallower in non-functional zone 122, while deeper in functional zone 120 to further enhance the child resistant functions and features. In addition, the female shoulders 112 and barbs 14 and catches 110 can be adjusted in relation to one another to facilitate a non-operative zone.

Figure 8:
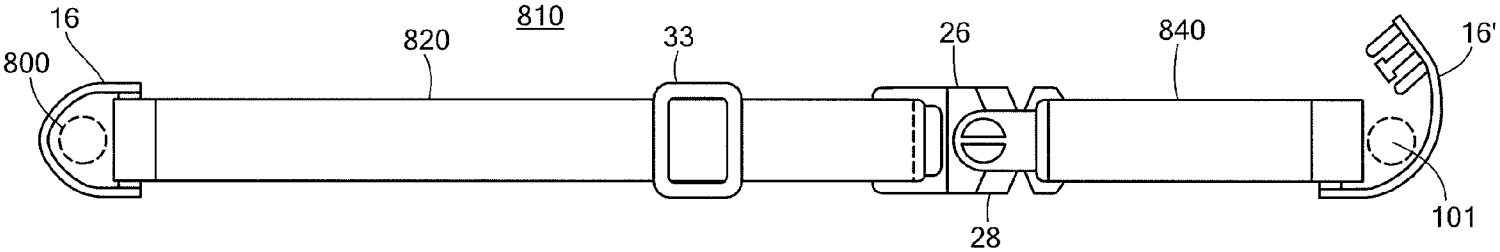
FIG. 8 is a plan view of a seatbelt with a buckle according to the present invention.

Referring now to FIG. 8, a child restraint seatbelt assembly 810 is shown. Seatbelt assembly 810 includes a first strap portion 820 and a second strap portion 840. First and second strap portions 820 and 840 can be coupled to a device for carrying or restraining a child, such as a shopping cart for example. Bars 800 and 101 are illustrated in phantom in FIG. 8 to show parts of a typical shopping cart to which assembly 810 can be attached.

Strap retainers 16 and 16' permit strap portions 820, 840 to be fastened to a shopping cart without the use of tools. Any type of retainer mechanism including clasps, rings and loops can be used. The retainer mechanism should not be considered to be so limited, however, and need only function to attach strap portions 820, 840 to an object. For example, the retainers can be permanently attached to strap portions 820, 840 or can be removably attached. Also, the retainers can be produced separately from assembly 810, and provided with straps 820, 840 to be assembled on site, for example. Assembly 810 can be adjusted with a known belt adjuster 33. FIG. 8 shows female and male buckle connector parts 26 and 28, respectively. Buckle connector parts 26 and 28 are fastened to strap portions 820, 840, respectively, in a known manner.

Figure 9:
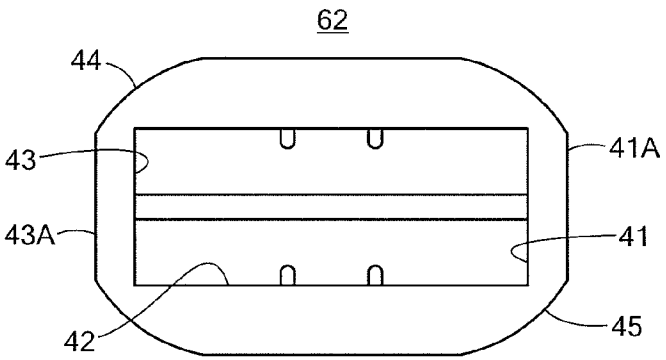
FIG. 9 is an end side view of a socket part according to another embodiment of the present invention.

Referring now to FIG. 9, a female buckle connector part 62 according to the present invention is shown. Connector part 62 has a partially oval shape described by arcuate section surfaces 44 and 45 with a rectangular inner surface shape defined by planar surfaces 41, 42, 43 and 46. Accordingly, a standard male connector, or male connector part 20 according to the present invention can fit into and engage with female connector part 62. Arcuate surfaces 44 and 45 provide a structural integrity enhancement to female connector part 62 because a cross-section of material between surfaces 44 and 46 and/or 42 and 45, for example, is dome-shaped or partially thickened. In addition, the increased material between surfaces 44 and 46 and/or 42 and/or 45, 41 and/or 41A, and/or 43 and/or 43A for example, as compared to prior art connectors, enhances the ability of connector part 62 to withstand external forces, including increased tensile, impact and compression forces. For example, it is estimated that the advantages of the design of connector part 62 described above results in a threefold increase in resistance to impact forces.

The body width of conventional buckles vary in relation to standard buckle sizes and styles. Wall thickness varies somewhat in proportion to body width in that the wall thickness may increase slightly as body width increases. However, when the buckle according to the present invention is scaled in proportion to increased body width, wall thickness is consistently thicker than typical conventional buckles. For example, size 25 mm or 1 inch buckles, such as those used in shopping cart seatbelt applications, or smaller sizes, are typically less than 35 mm in width at the widest body measurement. Wall thickness of the female or receiving connectors of conventional buckles of these types are typically in a range of about 0.04 to 0.06 inches. Exceptions do exist where minor wall thickening is observed to facilitate ornamental design, improve material flow in the mold, or to compensate for the use of inexpensive material in critical areas. However, the overall surface areas typically have a wall thickness of less than about 0.07 inches. Buckles attempting to provide a child resistant feature that rely on a third latch element use the same typical thin wall design employed in other conventional buckles. Indeed, manufacturers of conventional buckles that produce buckles with child resistant features use similar wall thicknesses to those that are used for non-child resistant buckles. In contrast, the buckle according to the present invention preferably has a wall thickness range of from 0.07 inches to about 0.14 inches. This increased wall thickness accounts for more than 29% more material than an identical buckle manufactured with typical wall thickness. Another known buckle that attempts to provide child resistant features is a 3 point buckle, illustrated in U.S. Pat. No. 6,684,466. As manufactured, this buckle has wall thicknesses of about 0.06 inches, is molded from nylon and has a size of about 25 mm.

Although some prior art buckles are relatively large in size, their wall thickness remains relatively constant. So, even when buckles are made to have larger dimensions, the wall thicknesses do not increase in proportion to the size dimensions. This phenomenon is often the result of the motivation on the part of manufacturers to reduce costs by minimizing the amount of material used to make each buckle. A comparison of the weights of three different buckle sockets or female parts in sample sizes of 5 is provided below. Set A is a weight sample of buckle sockets made according to the present invention except without the features of the thickened walls.

Set B shows weights derived from buckle sockets made in accordance with the present invention with the thickened wall feature. Set C shows weights that represent samples of a prior art buckle socket with dimensions that are larger in practice than those of the present invention, while providing a wall thickness that is less than that achieved with the thickened wall feature.

Buckle A (W/O Thickened Wall Feature)

1) 5.21
2) 5.18
3) 5.19
4) 5.20
5) 5.24

Buckle B (with Thickened Wall Feature)

1) 6.70
2) 6.70
3) 6.85
4) 6.63
5) 6.72

Buckle C 1) 6.89
2) 6.88
3) 7.05
4) 6.88
5) 6.94

While conventional buckles in certain applications, such as those used in shopping carts, often have a wall thickness of less than about 0.07 inches, the buckle according to the present invention preferably has a wall thickness range of from about 0.07 inches to about 0.14 inches. The additional wall thickness provides significant increases in resistance to stress and external forces. Accordingly, the design of connector part 62 also resists deformation that can occur with applied compressive forces. Because of the greater resistance to external forces exhibited by connector part 62, a more substantial male connector part can be used. Use of more substantial male connector can increase overall resistance of the buckle to external tensile, impact and compression forces. A more substantial male connector can also further assist the child-safety feature of the present invention and provide a more robust and longer lasting seatbelt assembly.

Figure 10:
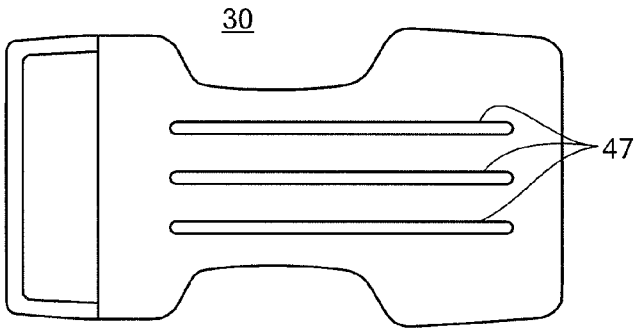
FIG. 10 is a plan view of a socket part according to another embodiment of the present invention.

It should be clear that the embodiment shown in FIG. 9 is not limiting for the present invention, in that a number of strengthening structures can be used. For example, FIG. 10 illustrates arcuate section surface 44 replaced with or augmented by several ribs 47 extending in a lengthwise direction. It should be apparent that ribs 47 can be extended in any direction. A series of arcuate surfaces covering separate portions of connector part 62 can be used as well. A reinforcing structure can also take the form of a web, or criss-crossed ribs. Additionally, each of these reinforcing or strengthening structures can be used in combination with each other, or with other similar structures for reinforcement or strengthening.

In many previous buckles provided with seatbelts, a number of different materials have been used to form the buckles to obtain various advantages. One overriding goal, however, of buckle manufacturers has been the reduction of the amount of material used to form the buckle components. A particular design goal has been to design a buckle with a structure that has enough rigidity and support to function properly in the desired application, without overdesigning, or adding excess material that may not contribute to supporting the application design. So, for instance, designers typically specify the wall thickness of the buckle to be less than 0.07 inches, as stated above, while choosing a suitable material for forming the buckle that exhibits the desired physical characteristics at those specified dimensions. Some typical materials used in prior buckles include delron, nylon, or acetal. Some prior buckles have also been formed with impact modified nylon known by trade name ST801 by Dupont. In environments where the buckles may be subjected to harsh treatment, such as in the case of shopping cart seatbelts, where the nesting of the shopping carts introduces high impact and compressive forces on the buckles, high impact nylon has been observed to produce superior results with respect to resisting high impact and compressive forces, where buckles made of other materials tend to permanently deform, break or shatter.

In the case of a child resistant buckle, maintaining the tolerances of the buckle components is often a key to maintaining the child resistant feature of the buckle. For example, some child resistant features rely on a number of concurrent or sequential steps to uncouple a buckle that a typical child cannot overcome. If the buckle is deformed or broken such that one of the operative steps is difficult or missing altogether, such as in the case of a bent or broken tang or actuating button, the child resistant feature may be lost. In another example, some child resistant features may rely on the difficulty of operating the buckle mechanism to prevent a child from uncoupling the buckle. When the buckle is subjected to high impact and compressive forces, as is typical in some harsh environments, as discussed above, the child resistant feature can become extremely difficult to disengage, or overly easy to disengage, and therefore defeat the purpose for having the child resistant feature.

In accordance with the present invention, the child resistant buckle is composed of high impact nylon with a sufficient amount of material to avoid large variations in tolerances. The material bulk and structures contribute to avoiding deformation or failures such as cracking that might otherwise result from high impact, tensile and compressive forces. In conjunction with the additional child resistant features of the buckle, the use of high impact nylon further serves to maintain the child resistant features and further adds to the child resistant features by virtue of the characteristics of the material. That is, not only does the use of high impact nylon contribute to maintaining the tolerances of the child resistant buckle, it also serves to provide a certain resiliency to the buckle so that desired tolerances for child resistant features can be maintained. By using impact modified nylon in conjunction with thickened wall ranges for the female buckle member, the buckle is made more resistant to impact, tensile and compression forces to thereby avoid damage and variation based on exposure to harsh or abusive environments. While other materials typically used to produce buckles have been found to deform permanently, break or shatter, thereby becoming inoperative or losing a desirable feature, such as child resistance, the buckle according to the present invention composed of high impact nylon continues to function well. The use of impact modified nylon to form the buckle according to the present invention where the female connector has arcuate surfaces or other reinforcing structures contributes to the overall durability and length of life for the buckle.

Impact tests were performed on a variety of buckles with a child resistant feature, including a buckle that includes features of the present invention, represented below as Buckle B. Buckle B also includes the feature of thickened walls to resist loading forces such as impact and compression, while Buckle C lacks this feature, as indicated above. The tests were performed using a guided cylindrical steel weight dropped once from an adjustable height onto each test buckle. The test buckle was placed on a flat metal surface to receive the steel weight. A failure was determined if the buckle no longer functioned as desired for any reason, including failures due to cracking. The results of the testing are tabulated below.

Buckle B
composed of: impact modified nylon
male/insertion member: passed at 72 ft.lbs.
female/receiving member: passed at 106 ft.lbs.
assembled together: passed at 72 ft. lbs.
Buckle C
composed of: nylon.
male/insertion member; failed less than 30 ft. lbs.
female/receiving member: failed less than 30 ft. lbs.
assembled together: failed less than 30 ft.lbs.
Buckle D
(buckle B composed of Nylon):
male/insertion member: passed 36 ft. lbs.
female/receiving member: passed 36 foot. lbs.
assembled together: passed 36 foot lbs.

The results of these tests indicate that the child-resistant buckle according to the present invention withstands significantly greater amounts of impact loading than do the child-resistant buckles of other configurations.

Additional tests were also run to determine the effect of structure and materials on the operation of child safety buckles formed according to alternate designs. The tests consisted of forming the '985 buckle, the '374 buckle and a buckle with features according to the present invention out of various materials and subjecting the buckles to impact testing. The buckles were formed from acetal, nylon and impact modified nylon. In addition, the '985 buckle and '374 buckle formed from nylon were modified to have structures in accordance with the present invention, such as thickened walls or additional material, and subjected to impact testing. The buckles were subjected to impacts with at various levels of foot-pounds, and the foot-pounds at which a buckle failed were noted. Failure of a buckle, or buckle part, was defined as being inoperative, being permanently deformed or cracking. Some relevant examples of test results follows.

The '985 Buckle:
composed of: nylon
male/insertion member: failed at 4 ft-lbs.
female/receiving member: failed at 4 ft-lbs.
assembled together: failed at 4 ft-lbs.
The '374 Buckle:
composed of: nylon
male/insertion member: failed at 1 ft-lbs.
female/receiving member: failed at 1 ft-lbs.
assembled together: failed at 2 ft-lbs.
Buckle with Inventive Features
composed of: impact modified nylon
male/insertion member: failed at 25 ft. lbs.
female/receiving member: failed at 20 foot. lbs.
assembled together: failed at 30 foot lbs.

As can be seen from the exemplary testing results, the structural features and material of the present invention improves the impact resistance of the buckle. Indeed, the testing results indicate that if the '374 buckle and '985 buckle are formed with impact modified nylon, a significant increase in resistance to impact forces is expected.

Figure 11:
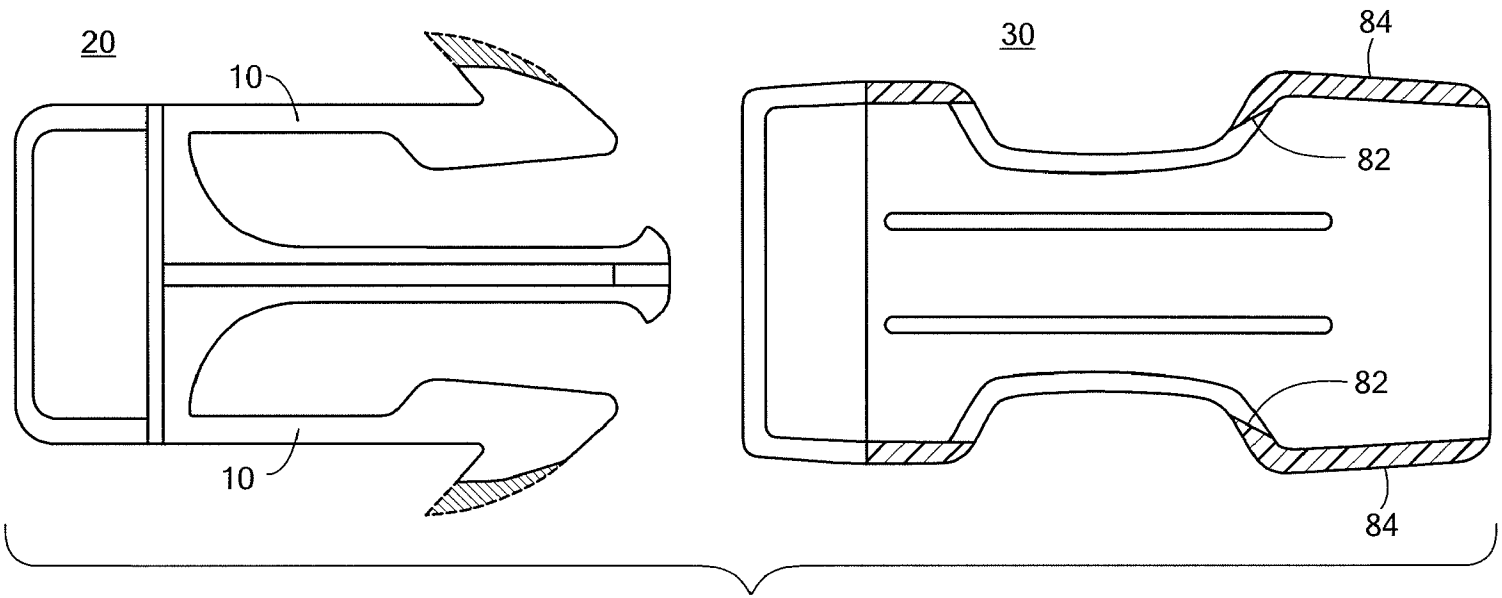
FIG. 11 is a plan view of another embodiment of a male and female portion illustrating a feature of a safety buckle according to the present invention.

Additional structural or child resistant features can be applied to female connector 30. Referring to FIG. 11, for example, a shoulder portion 82 of lateral sides 84 of female connector 30 provides an extended engagement surface. By providing extensions to the shoulder portion 82, the prongs on male connector 20 do not disengage from female connector 30 until side latches 10 are compressed together a further distance. The inward extension of the shoulder portions can also contribute to preloading side latches 10 to further enhance the child-resistant feature. That is, not only are the tangs displaced a greater distance to open the buckle because of the extended shoulder portions, but the force to displace the tangs over the displaced distance is likewise increased because of the preloading action.

Each of the above described features for increasing the compressive force resistance of the prongs on male connector 20 all have the same goal of providing a child resistant buckle. Each of the above described features accomplish this goal in different ways, with one effect being to increase the pressing force applied to the prongs of male connector 20 to disengage the buckle. One of the factors that becomes important in adopting a buckle design to increase an applied force sufficient to disengage the buckle is repeatability under stress. That is, the design should be able to provide a threshold pressing force on a consistent basis, even when subjected to compressive and impact forces that are somewhat typical of buckles in an ordinary shopping cart environment, for example.

Accordingly, the improvements to the connector 30 serve to preserve the tolerances of the buckle associated with aspects of the child-resistant feature. That is, by making female connector 30 more robust and resistant to impact and compressive forces, the buckle is less likely to experience tolerance changes that may affect the child resistant feature.

A pressing force threshold level for disengaging the buckle is believed to be an effective child resistant measure that can be verified through empirical data and field studies. Provided that the threshold level is set high enough, children in a certain age range should typically be unable to open the buckle, while adults or responsible minors can easily open the same buckle.

The child resistant buckle should also be easily opened by adult individuals with typically less pressing strength. For example, an individual of age 60 or greater typically has less of an ability to apply a pressing force to disengage the buckle, than does an individual of age 30 when all other factors are balanced and taken into account. Accordingly, a child resistant buckle based on a threshold level for a pressing force should be high enough to be inoperable for a child of a given age, but still easily operable for individuals of a given age range.

In a survey conducted by Mathiowetz et al. in 1985, 310 males ages 20-94 and 318 females ages 20-94 were tested to determine pinch force ability between a thumb and index finger. The results were aggregated to obtain an average pinch force for both the male and female sample populations. The results of the survey indicated that the males exert an average pinch or pressing force of 16.93 pounds with a standard deviation of 0.918, while females exert an average pinch or pressing force of 11.36 pounds with a standard deviation of 0.582. A child resistant buckle is thus preferably openable with 10.78 pounds of force or less, provided the force is great enough to be child resistant.

In conducting an extensive and exhaustive study of the amount of pressing force able to be exerted by a child aged and younger, it was found that a certain pressing force threshold will prevent nearly all instances of undesirable operation of the buckle by a child in the above-mentioned age range. A study was conducted by Owings in 1977 to determine average maximum pinching strength of children in the age range of 3½ to 4½. The study concluded that the average maximum pinching strength for the children tested was about 5.7 pounds over a distance of about 2 cm. Over a distance of about 5 cm, the resulting strength applicable was 6.39 pounds. Accordingly, a threshold level for a 3 cm wide buckle with increased resistance to pressing force for children aged 4½ and younger should be approximately 5.93 pounds of force. Below this level, children aged 4½ and younger are increasingly able to operate the buckle as the force diminishes. Above this level, children aged 4½ and younger are typically unable to operate the buckle. With regard to adult operation, the preferable maximum amount of force to open a buckle is less than about 10.78 pounds (average minimum-standard deviation), as described above. Accordingly, it would be desirable to provide a buckle with an opening force that is greater than approximately 5.93 pounds, but less than approximately 10.78 pounds.

An extensive study of available buckles has been conducted to determine whether any known buckle meets this criteria. At the end of this exhaustive study, it was determined that only a buckle constructed according to the present invention consistently met the desired criteria of child resistance with a simple and intuitive construction and operation.

Accordingly, by providing a buckle that has a consistent opening force equal to or greater than approximately 5.5 pounds, for example, the present invention is able to achieve child resistant results unmatched by any other buckle. When the buckle according to the present invention is constructed to consistently have greater than 6.0 pounds of pressing force to permit opening, the buckle should exceed the ratings at which children under the age of 4½ are able to open the buckle. Thus, the buckle according to the present invention is consistently child resistant, where other buckles are unable to provide such a feature.

In studies to validate the child resistance of the buckle according to the present invention, in which a pressing force of approximately 5.5 pounds or greater would disengage the buckle, only about 4% of children aged approximately 48 months and younger were able to successfully operate the buckle. Accordingly, the buckles were found to be 96% child resistant to children in a group of 50 with ages approximately 48 months and younger. The buckle design according to the present invention is, however, easily openable by adults who are typically easily able to exert a force of about 10 pounds to disengage the buckle. The applied force is developed as a pinching force against the two prongs so that both prongs are disengaged from the female member.

In another study to evaluate the child resistant features and capabilities of the buckle according to the present invention, the buckle was independently tested with panels consisting of 100 seniors ranging in age from 50-70 years old and 100 children ranging in age from 42-51 months in an even distribution. The buckle according to the present invention fulfilled and surpassed the requirements for present regulations related to child-resistant systems. The buckle according to the present invention is the only buckle known to accomplish this achievement.

Another child resistant feature for the compression fit type buckles discussed herein is obtained by varying a width of the buckle in conjunction with pressing force. That is, it is more difficult for a child to pinch the prongs of a narrow buckle with enough leverage to exert pressure sufficient to open the buckle than it is for a wide buckle. Accordingly, as the width of the buckle decreases, the force threshold to make the buckle child resistant also decreases, making the buckle easier to operate for adults, while still being child resistant. Conversely, as the buckle width increases, the force threshold for child resistance increases. Several prior art buckles have typically greater widths than the buckle according to the present invention, however, pressing force does not increase with width in these prior art buckles. Accordingly, not only are the wider prior art buckles more susceptible to being opened by a child, they do not meet the threshold for child resistance according to the present invention. As an example, one buckle measures 4.0 cm, and has an average minimum opening force of 5.6 pounds. The greater width and the minimum opening force combine to decrease the child resistance available in the buckle design.

The invention thus provides a simpler, more intuitive way of providing a child resistant buckle for a seatbelt assembly that utilizes the same releasing actions as in the prior art buckle so that consumers will be accustomed to its use the first time it is used. According to a feature of one exemplary embodiment, the buckle calls for a greater force to be applied to unclasp the buckle and release the seatbelt assembly. The force applied should be enough so that the buckle is difficult to unclasp for a typical child but can be easily operated by the children's parents or guardians or other adult supervisors.

Figure 12:
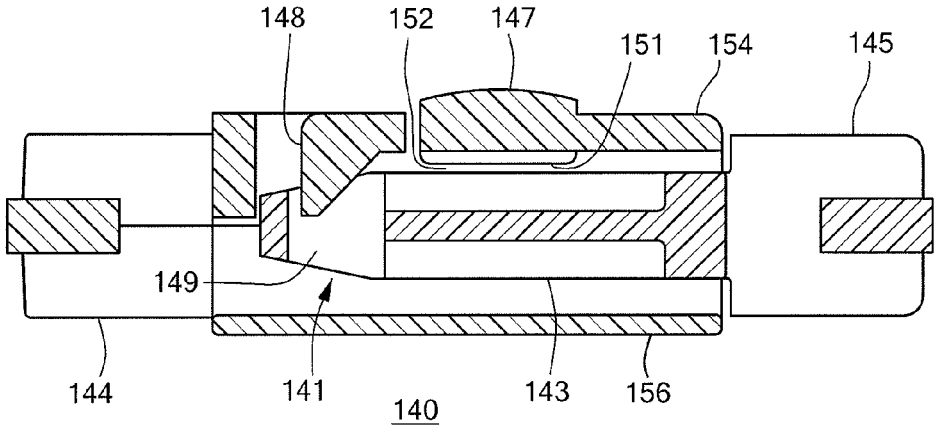
FIG. 12 is a cross-sectional side view of an embodiment of a safety buckle according to the present invention.
Figure 13:
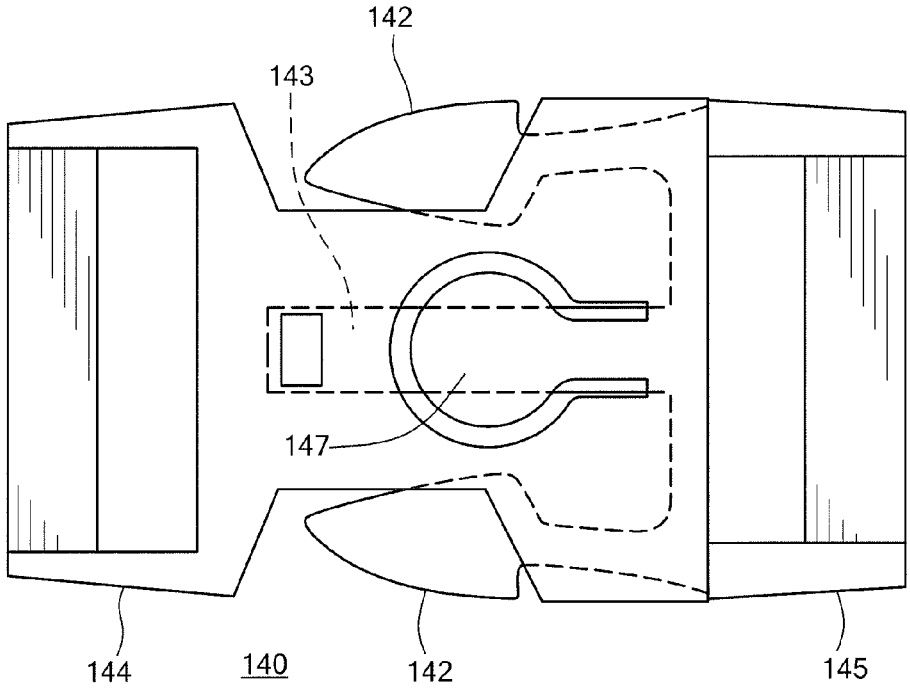
FIG. 13 is a plan view of a clasped buckle according to an embodiment of the present invention.

Referring now to FIGS. 12 and 13, a buckle 140 according to the present invention is illustrated in an assembled state. Female member 144 receives male member 145 in a latched position to clasp buckle 140. Female member 144 includes a catch extension 148 that cooperates with an opening 149 on male member 145. Male member 145 is disengaged from female member 144 when side tangs 142 are pinched together and center arm 143 is freed from catch extension 148. Center arm 143 is deflected away from catch extension 148 to be free of catch extension 148 to permit male member 145 to be disengaged. A button 147 acts as an actuator to deflect center arm 143 away from catch extension 148. Button 147 includes an actuating area 151 that contacts center arm 143 and displaces it away from catch extension 148. In an exemplary embodiment, a gap 152 is provided between actuating area 151 and center arm 143 so that button 147 moves through a non-operative range before actuating area 151 begins to influence center arm 143. Gap 152 accordingly provides a non-operative range for the actuation of button 147 to promote a child resistant feature where button 147 appears non-operative when a child attempts to actuate button 147.

Female member 144 includes a top wall 154 and a bottom wall 156 that contribute to support for the structural integrity of female member 144. In addition, male member 145 includes a tapered area near opening 149 to contribute to the operability of buckle 140. When center arm 143 is displaced away from catch extension 148, tapered area 141 contributes to easing the release of center arm 143 from catch extension 148 by providing additional clearance so that the latching mechanism operates with less deflection, and without the application of an overly burdensome force. Center arm 143 can generally remain at a thicker dimension than tapered area 141, so that the structural integrity of male member 145 is maintained, and center arm 143 provides a suitable resistance to actuation when button 147 is pressed. Through opening 149 also permits catch extension 148 to extend further than otherwise might be feasible, while maintaining a reversible feature. Catch extension 148 can extend into through opening 149 to contribute to securing male member 145 and female member 144. In this embodiment, at least two of the latching mechanisms are arranged on adjacent sides or surfaces of the buckle, and are not opposed to each other.

Figure 14:
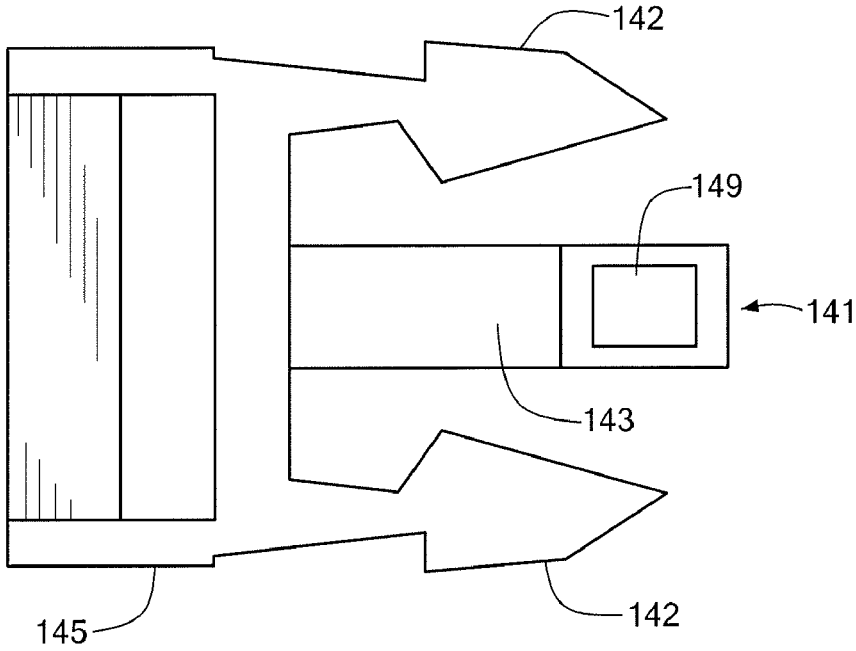
FIG. 14 is a plan view of a plug part according to an embodiment of the present invention.

Referring now to FIG. 14, another illustration of male member 145 is provided. Through opening 149 is shown on center arm 143 in tapered area 141 to serve as a latch member for securing male member 145 in buckle 140.

Figure 15:
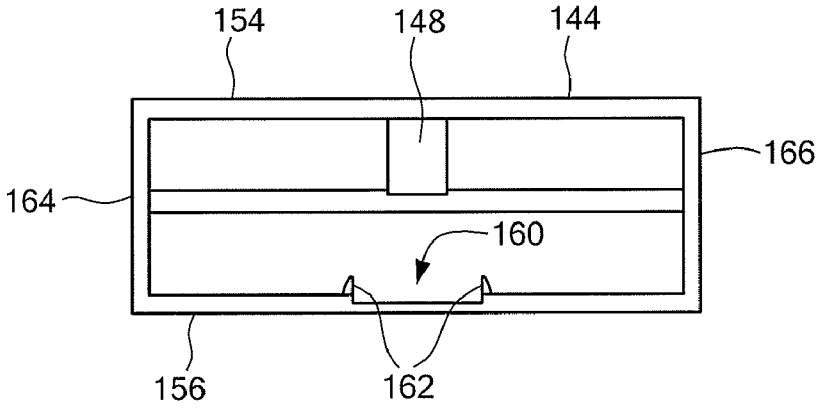
FIG. 15 is an end side view of a socket part according to an embodiment of the present invention.

Referring to FIG. 15, female member 144 is illustrated with a view of an opening for receiving male member 145. Catch extension 148 is illustrated in the center of the view of female member 144 for engaging center arm 143 of male member 145. In addition, a slot or trench 160 is illustrated in a side of bottom wall 156. Trench 160 provides a clearance for the deflection of the center arm 143 when male member 145 is disengaged from female member 144. Accordingly, trench

160 eases the operation of center arm 143 during a disengagement operation to facilitate an easy unclasping operation. Female member 144 may also include guide rails 162 that project upward from bottom wall 156. Guide rails 162 help to guide center arm 143, and male member 145 into female member 144 without lateral rotation, and also tend to stabilize the clasped buckle to prevent inadvertent unclasping through rotation or other lateral forces. It should be apparent that guide rails 162 may be alternately or additionally positioned on a side of top wall 154 to improve stability, for example.

Because male member 145 is reversible, it may be inserted in female member 144 in any orientation and still achieve the objects and advantages of the present invention. An important goal of the buckles illustrated according to the present invention is that they be operable on an intuitive level by users that may be encountering the buckle for the first time. Accordingly, the buckle should be easy to operate and operate in a consistent manner. The reversible feature of the present invention permits the user to insert male member 145 into female member 144 in any orientation so that the intuitive operation of the buckle is improved. The cooperating features of through opening 149, catch extension 148, tapered area 141 and trench 160 serve to provide a robust latch mechanism, while facilitating a simple and convenient opening mechanism to unclasp buckle 140.

The above-described features can be made consistent when buckle 140 is produced with designs that allow flexibility and tolerances, and with materials that do not permanently deform over a significant amount of time. Accordingly, buckle 140 is designed to have structural features to prevent deformation of buckle 140, even when it is subjected to high impact and compressive loading. Because buckle 140 is made out of impact modified nylon in an exemplary embodiment, buckle 140 tends to be relatively pliable, which improves the resistance of the buckle to cracking, stress fractures, or breaking. In addition, side tangs 142, center arm 143 and catch extension 148 can be made more robust and thicker yet remain pliable to facilitate use, thereby improving durability while maintaining operative ease. Also, top and bottom walls 154, 156, as well as side walls 164, 166 of female member 144 can be made thicker to resist impact or compressive loading. Walls 154, 156, 164, 166 can also include structural elements to improve their resistance to loading, such as ribs, arc of thicker material, and the like. The structure of buckle 140 compensates for the pliability of the impact modified nylon so that buckle 140 can withstand higher external force loading, as well as wide variations in temperature and humidity as are typically experienced in outdoor use.

The female connector of the present invention can absorb greater external forces, and results in a more robust design overall. With a stronger female connector according to the present invention, a stronger male connector can also be used, effectively improving child-resistancy of the seatbelt assembly without adding further complexity. The arcuate shape of the female connector part surfaces, and/or thickened wall portions, achieves greater strength while avoiding a large increase in the amount of material needed.

Although ribs, struts, webs, flanges and enlarged barbs are shown for the male connector, other embodiments can be developed which are in accordance with the concepts disclosed herein. Although arcuate surfaces are shown for the female connector, other embodiments including those described hereinabove, can be developed and applied that are in accordance with the concepts disclosed herein. Further, combinations of the above embodiments can be provided. Further, the enlarged prongs or barbs of FIG. 5 can be provided along with strengthened latch parts as in FIGS. 2-4. Further, an impact modified nylon composition known generically as impact modified PA66 or high impact PA66 or toughened PA66, and commercially as ST801, is preferably used as the buckle material, although other polymers or other formulations can be used. A non-exhaustive list of preferred material for constructing the buckle includes nylon, toughened nylon or toughened PA66, high impact nylon or high impact PA66, impact modified nylon or impact modified PA66. In addition, one or more surfaces of the female connector can have arcuate surfaces to increase the strength of the connector and reduce the risk of tolerance losses due to impact or compressive forces. The use of an impact modified nylon, in particular ST801, enhances the ability of the buckle to retain the child-resistant features that may be at risk due to repeated exposure to impact or compressive forces. That is, the use of impact modified nylon contributes to the child-resistant features by avoiding loss of tolerances in the face of impact and compressive forces, where other materials might permit deformation or loss of tolerances leading to the loss of child resistant features. This is further enhanced with the preferred material ST801 and other forms of impact modified or toughened nylon.

When the buckle is composed of ST801, the buckle tends to be easier to operate, i.e., less pressing force is needed to open the buckle. Accordingly, the buckle design is modified to increase pressure force to open the buckle when ST801 is used as the buckle material.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A child resistant buckle, comprising:

first and second buckle members shaped to be cooperatively joined in a clasped condition;

a child resistant latching mechanism including releaseably cooperative components on the first and second buckle members respectively, arranged to be releaseably cooperative when the first and second buckle members are joined in the clasped condition to retain the first and second buckle members together, the latching mechanism being constructed to prevent release when an applied actuation force to disengage the cooperative components is less than a predetermined level;

the first and second buckle members being composed of impact modified nylon and having walls with a wall thickness in a range of from about 0.07 inches to about 0.14 inches, the composition and wall thickness enabling the first and second buckle members to withstand an increased impact loading in a range of from about 4 ft-lbs to about 70 ft-lbs without failure; and the composition and wall thickness further enabling the first and second buckle members to withstand the impact loading to avoid modification of the predetermined level.

2. The buckle according to claim 1, wherein the impact loading range is from about 6 ft-lbs to about 70 ft-lbs.

3. The buckle according to claim 1, wherein the impact loading range is from about 8 ft-lbs to about 70 ft-lbs.

4. The buckle according to claim 1, wherein the impact loading range is from about 10 ft-lbs to about 70 ft-lbs.

5. The buckle according to claim 1, wherein the impact loading range is from about 12 ft-lbs to about 70 ft-lbs.

6. The buckle according to claim 1, wherein the impact loading range is from about 14 ft-lbs to about 70 ft-lbs.

7. The buckle according to claim 1, wherein the impact loading range is from about 16 ft-lbs to about 70 ft-lbs.

8. The buckle according to claim 1, wherein the impact loading range is from about 18 ft-lbs to about 70 ft-lbs.

9. The buckle according to claim 1, wherein the impact loading range is from about 20 ft-lbs to about 70 ft-lbs.

10. The buckle according to claim 1, wherein the impact loading range is from about 8 ft-lbs to about 40 ft-lbs.

11. The buckle according to claim 1, wherein the predetermined level is in a range of from about 5.5 pounds to less than about 16 pounds.

12. A child resistant buckle, comprising:

first and second buckle members shaped to be cooperatively joined in a clasped condition, one of the first and second buckle members including a base and a central arm with a first end connected to the base and a second end extending away from the base, another of the first and second buckle members including a cavity for receiving the central arm in the clasped condition;

a latching mechanism including a protrusion extending from an inner surface of the cavity and including a through opening at the second end of the central arm configured to receive the protrusion in a releasably cooperative arrangement when the first and second buckle members are joined in the clasped condition to retain the first and second buckle members together, the latching mechanism being released by displacement of the central arm to disengage the opening and the protrusion;

the first and second buckle members including a wall construction with a wall thickness of from about 0.07 inches to about 0.14 inches;

the buckle being composed of impact modified nylon; and the second end of the central arm being tapered to a smaller thickness nearer the second end such that the through opening provides a smaller depth at the smaller thickness to permit a lesser distance of displacement of the central arm to release the latching mechanism.

13. The buckle according to claim 12, wherein the impact modified nylon is ST801.

14. The buckle according to claim 12, further comprising an actuator configured and arranged for displacement of the central arm when actuated.

15. The buckle according to claim 14, wherein the actuator is arranged as a resilient member.

16. The buckle according to claim 12, further comprising an arcuate surface structure on the another of the first and second buckle members, wherein the arcuate surface structure provides a localized thickened wall section with a thickness of 0.07 inches to about 0.14 inches.

17. The buckle according to claim 12, wherein the composition and wall thickness enables the first and second buckle members to withstand an impact loading in a range of from about 4 ft-lbs to about 40 ft-lbs without failure.

18. The buckle according to claim 12, further comprising a trench in an inner surface of the cavity opposite the protrusion to receive the central arm when the latching mechanism is released such that a range of displacement for the central arm is increased.

19. The buckle according to claim 18, further comprising a relationship between the protrusion and the opening such that the protrusion and opening remain engaged during displacement of the central arm at least until the central is displaced into the trench.

* * * * *

UNITED STATES PATENT AND TRADEMARK OFFICE

CERTIFICATE OF CORRECTION

PATENT NO. : 7,681,288 B1
APPLICATION NO. : 11/220038
DATED : March 23, 2010
INVENTOR(S) : Paul Giampavolo It is certified that error appears in the above-identified patent and that said Letters Patent is hereby corrected as shown below:

Column 1, line 52, "20'" should read --20--;

Column 4, line 48, delete "functions.";

Column 8, line 13, "32 be" should read --32 to be--; and

Column 14, line 54, "and younger," should read --4½ and younger,--.

Signed and Sealed this
Twenty-second Day of February, 2011

David J. Kappos

David J. Kappos
*Director of the United States Patent and Trademark Office*